US009085961B2

(12) United States Patent
Ehalt

(10) Patent No.: US 9,085,961 B2
(45) Date of Patent: Jul. 21, 2015

(54) WELL CELLAR HIGH FLUID LEVEL ALARM

(76) Inventor: Keldon Ehalt, Calgary (CA)

( * ) Notice: Subject to any disclaimer, the term of this patent is extended or adjusted under 35 U.S.C. 154(b) by 945 days.

(21) Appl. No.: 13/276,757

(22) Filed: Oct. 19, 2011

(65) Prior Publication Data

US 2013/0099934 A1 Apr. 25, 2013

(51) Int. Cl.

| | |
|---|---|
| ***G01V 3/00*** | (2006.01) |
| ***E21B 47/04*** | (2012.01) |
| ***E21B 41/00*** | (2006.01) |

(52) U.S. Cl.

CPC ..... *E21B 47/042* (2013.01); *E21B 41/0021* (2013.01)

(58) Field of Classification Search

CPC ..... G08B 21/00
USPC ..... 340/853.1
See application file for complete search history.

(56) References Cited

U.S. PATENT DOCUMENTS

| | | | | |
|---|---|---|---|---|
| 2,853,041 | A | 9/1958 | Oakes | |
| 4,138,887 | A | 2/1979 | Logan | |
| 4,228,427 | A | 10/1980 | Niedermeyer | |
| 4,255,747 | A | 3/1981 | Bunia | |
| 7,637,692 | B1 | 12/2009 | Rose | |
| 7,830,268 | B1 * | 11/2010 | MacDonald | 340/612 |
| 2002/0047783 | A1 | 4/2002 | Bergum et al. | |
| 2004/0019258 | A1 * | 1/2004 | Kavounas et al. | 600/300 |
| 2004/0032335 | A1 * | 2/2004 | Parrish | 340/628 |
| 2004/0051739 | A1 * | 3/2004 | Schmickley et al. | 345/772 |
| 2004/0055828 | A1 * | 3/2004 | Kavounas | 187/306 |
| 2004/0158353 | A1 * | 8/2004 | Poterek et al. | 700/244 |
| 2005/0046571 | A1 * | 3/2005 | Stigall | 340/572.1 |
| 2005/0096848 | A1 * | 5/2005 | Hou et al. | 702/9 |
| 2007/0035407 | A1 * | 2/2007 | Capowski et al. | 340/679 |
| 2007/0046455 | A1 * | 3/2007 | Farley et al. | 340/509 |
| 2008/0001743 | A1 * | 1/2008 | Gallagher | 340/571 |
| 2008/0168807 | A1 * | 7/2008 | Dion et al. | 70/94 |
| 2008/0298978 | A1 | 12/2008 | Schulman et al. | |
| 2009/0050042 | A1 * | 2/2009 | Waldecker | 114/183 R |
| 2009/0261044 | A1 | 10/2009 | Godlien et al. | |
| 2010/0231394 | A1 * | 9/2010 | Finchum et al. | 340/632 |
| 2011/0085919 | A1 * | 4/2011 | Williams et al. | 417/63 |

* cited by examiner

*Primary Examiner* — Amine Benlagsir
(74) *Attorney, Agent, or Firm* — Maxey Law Office, PLLC; Stephen Lewellyn

(57) ABSTRACT

A well cellar high fluid level alarm includes a control box providing a water-tight enclosure and a alarm control circuitry disposed within the control box. An audible alarm indicator is operably connected to the alarm control circuitry. A visual alarm indicator is operably connected to the alarm control circuitry. A float switch is operably connected to the alarm control circuitry. An electrical power cable is operably connected to the control circuitry and provides electrical power thereto. A control switch is operably connected to the control circuitry and is operable to turn the control circuitry on and off. Operational indicator lamps are operably connected the control circuitry and operates to indicate an on or off state of the control circuitry. The control circuitry operates to operate the audible alarm indicator and the visual alarm indicator upon the float switch sensing a high fluid level.

5 Claims, 5 Drawing Sheets

WELL CELLAR HIGH FLUID LEVEL ALARM

FIELD OF THE INVENTION

The present invention relates generally to fluid level alarms, and more particularly, relating to specially designed fluid level alarm for use in connection with a well cellar during well drilling operations.

BACKGROUND OF THE INVENTION

In the process of drilling an oil well, a well cellar is dug into the ground through which the well bore is drilled. The well cellar serves to contain drilling equipment and to collect well drilling fluid (drilling mud) during drilling operations. A pump, sometimes referred to as a trash pump, is positioned within the cellar and is operated to continually pump fluid from well cellar to separate tanks Failure of the trash pump during drilling operations often results in the drilling fluid overflowing cellar and spilling out on to the surrounding ground.

Cleanup of the fluid spill is costly and may require reporting to regulatory bodies if the spill exceeds a certain volume of fluid. Accordingly, several procedures haven been attempted to prevent a spill. One procedure includes positioning a member of the drilling crew, often termed a "watch man" to observe the operation of the trash pump and warn the driller if failure occurs, thus allowing the driller to attempt to stop drilling operations in a sufficient amount of time to prevent an overflow condition. Placing a watch man is not desirable because it removes a man from the drilling crew that otherwise could be tending to more critical drilling operations. With the cost of drilling exceeding many thousands of dollars per hour, the loss of time due to the crew being a man short for the purpose of observing the trash pump can add up to substantial costs over the term of the well.

Another measure to prevent fluid spill includes utilizing a second trash pump in the cellar with the thought if one pump fails the other will still operate sufficiently to empty the cellar of collected fluid. However, this method tends to result in one or both of the pumps starving for fluid to pump, which is also used to cool the pump, resulting in premature pump failure from excessive heat.

Yet another measure includes running a pipe in the ground to connect the well cellar to the separate tanks such that the fluid can flow under the force of gravity from the cellar to the tanks However, this method is undesirable due to the considerable costs associated with the installation of the conductor pipe.

Accordingly, there is a need for an improved method and apparatus to observe the fluid level within the well cellar and to alert an operator to the existence of an undesirably high fluid level that indicates trash pump failure.

SUMMARY OF THE INVENTION

Embodiments of the present invention meets the needs presented above by providing a well cellar high fluid level alarm that operates to continually sense the fluid level within the well cellar and upon sensing a high fluid level condition operates visual and audible alarms to alert an operator of the high fluid level condition.

Embodiments of the present invention also provide a well cellar high fluid level alarm that is operable in cold weather environments and in ice conditions.

Embodiments of the present invention further provide a well cellar high fluid level alarm that is durable.

Embodiments of the present invention further provide a well cellar high fluid level alarm that is operable in hazardous environments and includes a float switch having an operation that is not impeded by frozen fluid located in the well cellar or if the float itself becomes ice encrusted.

Embodiment of the present invention further provide a well cellar high fluid level alarm that includes an emergency fluid pump disposed within the well cellar to pump fluid therefrom in the instance of trash pump failure.

To achieve these and other advantages, in general, in one aspect, a well cellar high fluid level alarm for use in connection with a well cellar during well drilling operations is provided. The alarm includes a control box providing a water-tight enclosure and a alarm control circuitry disposed within the control box. An audible alarm indicator is operably connected to the alarm control circuitry. A visual alarm indicator is operably connected to the alarm control circuitry. A float switch is operably connected to the alarm control circuitry. An electrical power cable is operably connected to the control circuitry and provides electrical power thereto. A control switch is operably connected to the control circuitry and is operable to turn the control circuitry on and off. Operational indicator lamps are operably connected the control circuitry and operates to indicate an on or off state of the control circuitry. The control circuitry operates to operate the audible alarm indicator and the visual alarm indicator upon the float switch sensing a high fluid level.

In general, in another aspect, the well cellar high fluid level alarm includes a fluid pump operably connected to the control circuitry and the control circuitry further operating to operate the fluid pump when a high fluid level is sensed by the float switch.

In general, in another aspect, the well cellar high fluid level alarm includes a control box mounted to a support of a derrick and provides a water-tight enclosure. Alarm control circuitry is disposed within the control box. An audible alarm indicator is mounted to a support of the derrick separate from the control box and in a position approximate to an operator. The audible alarm indicator is operably connected to the control circuitry. A visual alarm indicator is supported by the control box and is operably connected to the control circuitry. A float switch suspended above and within the well cellar and is operably connected to the alarm control circuitry. An electrical power cable is operably connected to the control circuitry and providing electrical power thereto. A control switch is operably connected to the control circuitry and is operable to turn the control circuitry on and off. An operational indicator lamp is operably connected the control circuitry and operates to indicate an on state of the control circuitry. A fluid pump is disposed within the well cellar and is operable to pump fluid within the well cellar to a position exteriorly of the well cellar. The fluid pump is operably connected to the control circuitry. The control circuitry operating to operate the audible alarm indicator, the visual alarm indicator and the fluid pump upon the float switch sensing a high fluid level within the well cellar.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
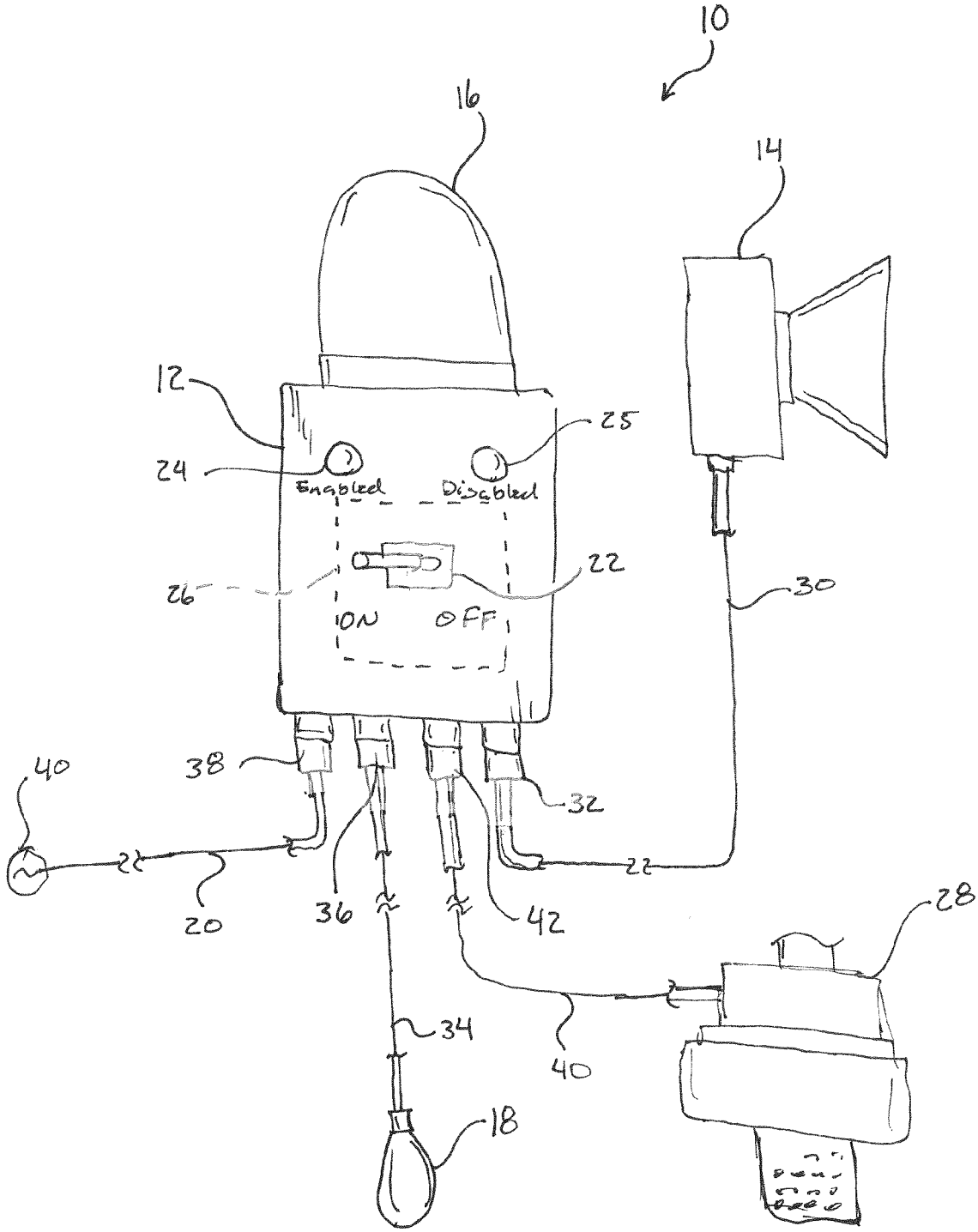
FIG. 1 is a diagrammatic front view of a well cellar high fluid level alarm constructed in accordance with the principles of an embodiment of the invention.
Figure 2:
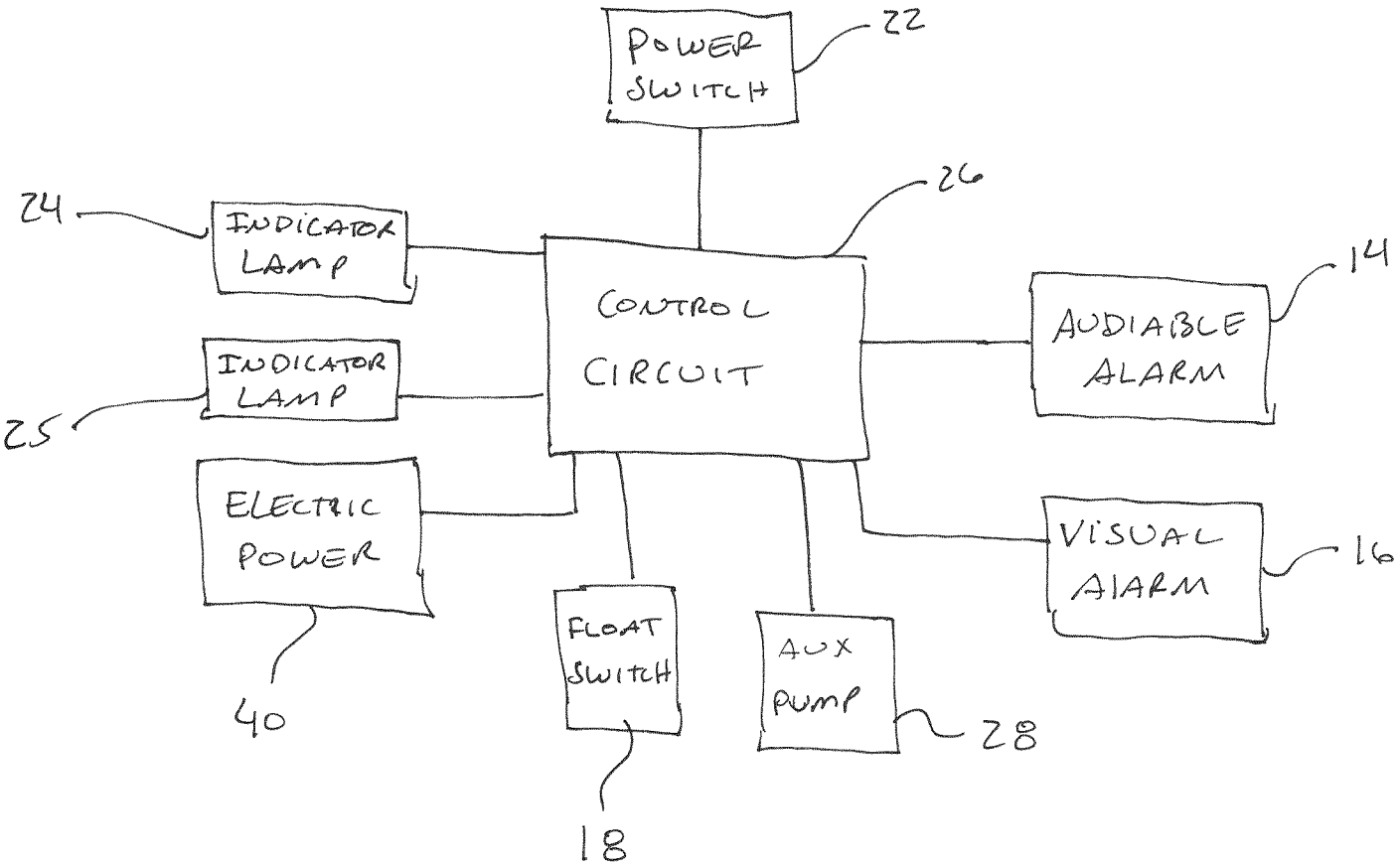
FIG. 2 is a block diagram of control circuitry and components of a well cellar high fluid level alarm in accordance with the principles of an embodiment of the invention.
Figure 3:
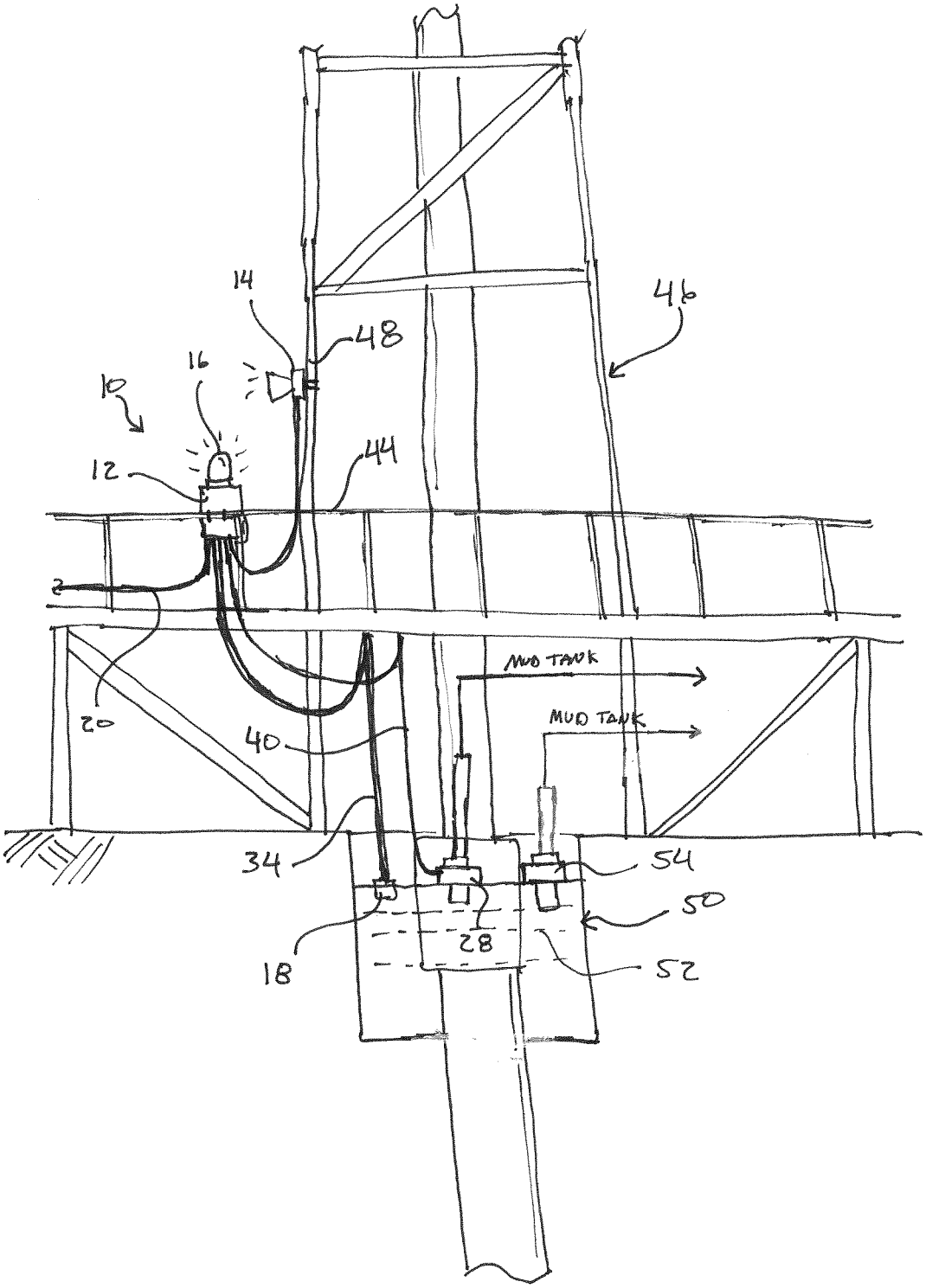
FIG. 3 is a diagrammatic environmental view of a well cellar high fluid level alarm in accordance with the principles of an embodiment of the invention.
Figure 4:
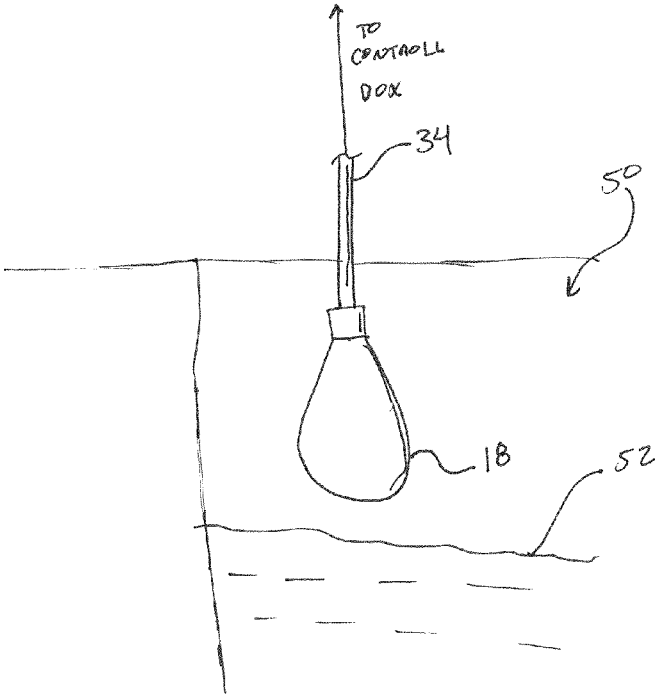
FIG. 4 is a diagrammatic view of a float switch of an embodiment of the invention, showing the float switch disposed within a well cellar having a low fluid level condition.
Figure 5:
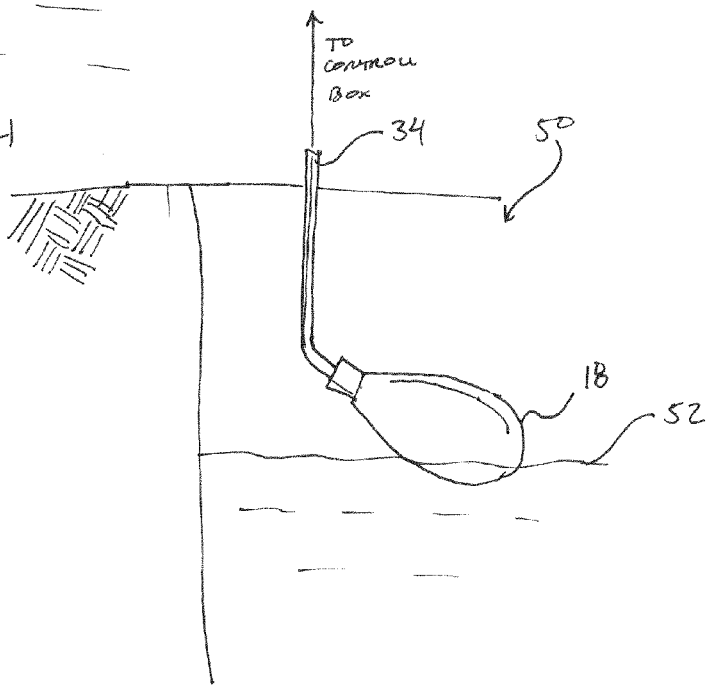
FIG. 5 is a diagrammatic view of a float switch of an embodiment of the invention, showing the float switch disposed within a well cellar having a high fluid level condition.

Referring now to FIGS. 1 through 5 of the drawings, there is representatively illustrated a well cellar high fluid level alarm 10 embodying the principals and concepts of an embodiment of the invention.

The well cellar high fluid level alarm 10 comprises a housing or control box 12, an audible alarm indicator 14, such as a speaker or the like, a visual alarm indicator 16, such as a strobe-light or the like, a float switch 18, an electrical power cable 20, one or more control switches 22, an operational indicator lamps 24 and 25, control circuitry 26, and optionally a fluid pump 28.

Control box 12 is constructed of a sturdy material, such as, but not limited to stainless steel or the like, and further has a sealed construction providing a water-tight enclosure which serves to house and protect control circuitry 26 from the hazardous environment in which the alarm 10 is intended for use. In an embodiment, it is contemplated the control box will be 10-inches wide, 12-inches high and 5-inches deep. While not illustrated here, the control box 12 may be fitted with any number of suitable mount assemblies permitting attachment of the control box to various structural supports located within the in-use environment as desired by an operator.

The audible alarm indicator 14 may be a speaker, such as a loud speaker or the like that is constructed for use in hazardous environments or any other suitable audio emitting device, such as, but not limited to piezoelectric devices. As illustrated here, the audible alarm indicator 14 is separate from the control box 12 so as to permit mounting thereof to a support structure as desired. However, it is contemplated the audible alarm indicator 14 may be attached to and supported by the control box 12. In the depicted configuration, the audible alarm indicator 14 includes a connector cable 30 that operably connects the audible alarm indicator to the control circuitry 26. Connector cable 30 may be fitted with an electrical connector 32 to permit decoupling of the connector cable 30. Electrical connector 32 may be an explosion-proof type connector that is suitable for use in hazardous environments.

The visual alarm indicator 16 may be a strobe-light of any suitable construction for use in a hazardous environment or other light emitting device for attracting attention. In the depicted embodiment, the visual alarm indicator 16 is attached to and supported by the control box 12. However, in other embodiments, the visual alarm indicator 16 may be separate from the control box permitting mounting of the visual alarm indicator to a support structure as desired. In this embodiment, the visual alarm indicator 16 would be fitted with a connector cable similar to the connector cable 30 of the audible alarm indicator 14. In either embodiment, the visual alarm indicator 16 is operably connected to the control circuitry 26.

Float switch 18 comprises an electrical switch (not illustrated) contained within a bulb-shaped, water-tight housing and is constructed for heavy duty and hazardous environment use. Such a type of float switch is readily known in the technical field. The float switch 18 is operably connected to the control circuitry 26 by connector cable 34. Connector cable 34 may be fitted with an electrical connector 36 to permit decoupling of the connector cable 34. Electrical connector 36 may be an explosion-proof type connector that is suitable for use in hazardous environments.

Power cable 20 is operatively connected to the control circuitry 26 to provide electrical power to the control circuitry and to provide electrical power to operate the electric components of the alarm 10, such as the audible alarm indicator 14, the visual alarm indicator 16 and the optional a fluid pump 28, etc. Power cable 20 may be hardwired to a source of line-power 40 or may be fitted with a suitable electrical connector permitting the power cable to be plugged into an electrical power outlet. Power cable 20 may also be fitted with an electrical connector 36 to permit decoupling of the connector cable 34. Electrical connector 36 may be an explosion-proof type connector that is suitable for use in hazardous environments.

Control switch 22 is supported by the control box 12 and is operatively connected to the control electronics 26 and operable by an operator to turn the alarm 10 on and off as desired by the operator. Operational indictor lamps 24 and 25 are also operatively connected to the control electronics 26 and are operated to illuminate when the alarm 10 is in the on or enabled (lamp 24) and when the alarm in off or disabled (lamp 25).

Alarm 10 may further include a fluid pump 28 that is configured to be positioned within the cellar of the well and operated by the alarm to pump fluid from the cellar when the alarm senses an undesired high fluid level within the cellar, as will be further discussed below. Pump 28 is operatively connected to the control electronics 26 a control or power cable 40 to receive electrical power and/or control signals from the alarm 10 to operate the pump. In embodiments, the pump 28 may be externally powered and receives control signals from the alarm 10 to control the operation of the pump. Power cable or control cable 40 may also be fitted with an electrical connector 42 to permit decoupling of the cable from the alarm 10. Electrical connector 42 may be an explosion-proof type connector that is suitable for use in hazardous environments.

The control box 12 is mounted to a support, such as, but not limited to a railing 44 of the drill derrick 46 in close proximity to the operator (not shown) of the derrick. In the embodiment depicted, the audible alarm indicator 14 is mounted to a support beam 48 of the derrick 46 and in close proximity to the control box 12 such that the operator is capable of hearing the sound emitted from the audible alarm indicator in an alarm state. In an alternative embodiment (not shown), the visual alarm indicator 14 may not be supported by the control box 12, and similar to the audible alarm indicator 14 would also be mounted to a support beam of the derrick 46 in a position that is most likely visible to the operator. Additionally, float switch 18 is positioned within the cellar 50 and is suspended from above by attaching the connector cable 34 to a suitable location on the derrick 46. The suspension height of the float switch 18 is adjusted to correspond to a high fluid level within the cellar 50.

In use, it can now be understood, during drilling operations, drilling fluid 52 also referred to as drilling mud fills the cellar 50 and is pumped from the cellar to mud holding tanks (not shown) by a trash pump 54 where the drilling mud is then recirculated for drilling. The drilling mud 52 contains, among other things, rock cuttings and other debris that is lifted to the surface by the flow of the drilling mud during drilling. The rock cuttings and other debris contained by the drilling mud often clog or damage the trash pump 54. In this circumstance, drilling mud 52 quickly fills and overflows the cellar 50, which is undesirable as discussed above.

In an instance of a trash pump 54 failure, the alarm 10 operates the audible indicator 14 and the visual indicator 16 to alert the drill operator of a high fluid level in the cellar 50 as sensed by the float switch 18. In which instance, the operator can take an immediate reactive response to stop drill operations to prevent the overflowing of the cellar 50. In embodiments of the alarm 10 wherein pump 28 is installed and positioned within the cellar 50, the alarm 10 will further operate the pump 28 to pump drilling mud 52 from the cellar to the mud tanks to provide the operator with a response time to shut down the drilling operations to prevent further filling of the cellar.

Figure 6:
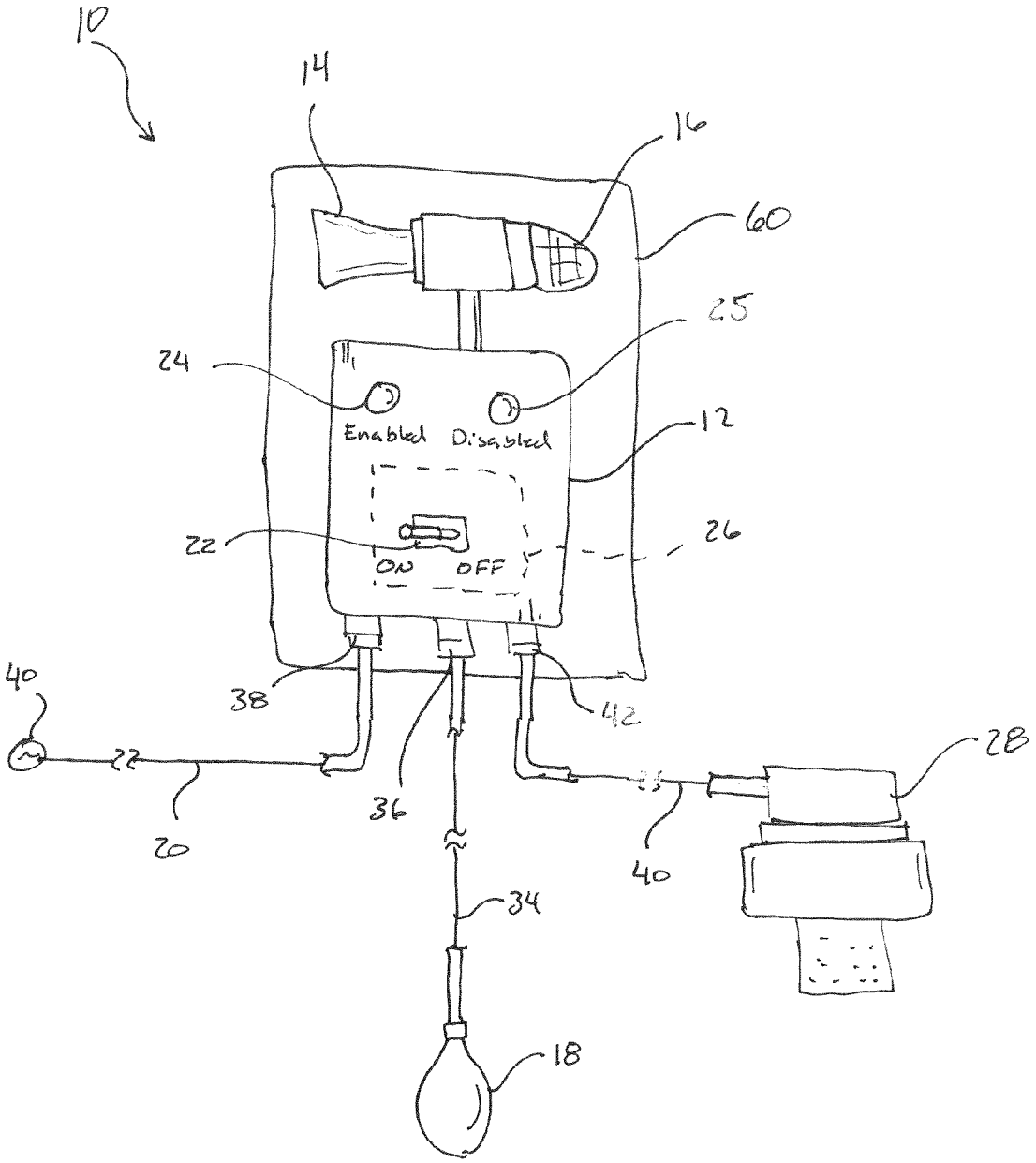
FIG. 6 is a diagrammatic view of a well cellar high fluid level alarm constructed in accordance with the principles of an embodiment of the invention.

Referring now to FIG. 6 there is illustrated an additional embodiment of the alarm 10 in accordance with the invention. Here, alarm 10 further includes a mounting plate 60 to which the control box 12, the audible alarm 14 and the visual alarm 16 are attached. The mounting plate 60 is then attached to support of a derrick.

A number of embodiments of the present invention have been described. Nevertheless, it will be understood that various modifications may be made without departing from the spirit and scope of the invention. Accordingly, other embodiments are within the scope of the following claims.

What is claimed is:

1. A well cellar high fluid alarm for use in connection with a well cellar during well drilling operations, said well cellar high fluid alarm comprising:

a control box mounted to a support of a derrick, said control box providing a water-tight enclosure;

alarm control circuitry disposed within said control box;

an audible alarm indicator mounted to the support of the derrick separate from said control box and in a position approximate to an operator, said audible alarm indicator operably connected to said alarm control circuitry;

a visual alarm indicator supported by said control box, said visual alarm indicator operably connected to said alarm control circuitry;

a float switch suspended above and within the well cellar, said float switch operably connected to said alarm control circuitry;

an electrical power cable operably connected to said alarm control circuitry and providing electrical power thereto;

a control switch operably connected to said alarm control circuitry and turns said alarm control circuitry on and off;

operational indicator lamps operably connected to said alarm control circuitry and operating to indicate an on state of said alarm control circuitry;

a fluid pump disposed within the well cellar and pumps fluid within the well cellar to a position exteriorly of the well cellar, said fluid pump connected to said alarm control circuitry;

said alarm control circuitry operating to operate said audible alarm indicator, said visual alarm indicator and said fluid pump upon said float switch sensing a high fluid level within the well cellar;

said audible alarm indicator is connected to said alarm control circuitry by a length of connector cable permitting mounting of said audible alarm indicator separately of said control box;

said float switch is connected to said alarm control circuitry by a length of connector cable permitting suspension of said float switch above and into the well cellar; and said fluid pump is connected to said alarm control circuitry by a length of cable.

2. The well cellar high fluid alarm of claim 1, wherein said visual alarm indicator is a strobe-light.

3. The well cellar high fluid alarm of claim 1, wherein said audible alarm indicator is a speaker.

4. The well cellar high fluid alarm of claim 1, wherein:

said connector cable said connecting said audible alarm indicator to said alarm control circuitry is fitted with an electrical connector permitting disconnection of said audible alarm indicator;

said connector cable said connecting said float switch to said alarm control circuitry is fitted with an electrical connector permitting disconnection of said audible alarm indicator; and said cable said connecting said fluid pump to said alarm control circuitry is fitted with an electrical connector permitting disconnection of said fluid pump.

5. The well cellar high fluid alarm system of claim 1, wherein said float switch is suspend by said connector cable said connecting said float switch to said alarm control circuitry.

* * * * *